US007908778B1

(12) United States Patent
Dushane

(10) Patent No.: US 7,908,778 B1
(45) Date of Patent: Mar. 22, 2011

(54) CUSTOMER ORDER AND BILLABLES CONFIRMATION METHOD

(76) Inventor: Steven Dushane, Granada Hills, CA (US)

( * ) Notice: Subject to any disclaimer, the term of this patent is extended or adjusted under 35 U.S.C. 154(b) by 532 days.

(21) Appl. No.: 11/775,104

(22) Filed: Jul. 9, 2007

(51) Int. Cl.
*G09F 3/10* (2006.01)

(52) U.S. Cl. ..... 40/638; 229/87.08; 426/106; 426/383

(58) Field of Classification Search ..... 40/637, 40/638; 229/87.08; 426/106, 383, 392; 283/81
See application file for complete search history.

(56) References Cited

U.S. PATENT DOCUMENTS

| | | | | |
|---|---|---|---|---|
| 4,479,838 | A * | 10/1984 | Dunsirn et al. | 156/247 |
| 6,113,148 | A * | 9/2000 | Koranda et al. | 283/81 |
| 6,800,167 | B1 * | 10/2004 | Frazer | 156/249 |
| 2006/0097042 | A1 * | 5/2006 | Kincaid | 235/383 |

OTHER PUBLICATIONS

"Trader Joe's Bag," http://www.flickr.com/photos/megancohen/115570677/, Mar. 20, 2006.*

* cited by examiner

*Primary Examiner* — Gary C Hoge

(57) ABSTRACT

The present invention comprises a system of labels located on wrapping and containers for individual food items. Each label contains an alphanumeric and/or graphic design that instantly brings to mind of restaurant personnel and to an unsophisticated customer (i.e., someone with no knowledge of the English language, children, or adults with limited education) the food item to be wrapped with the wrapping or container. In a preferred embodiment, a graphic device occupies a majority of the surface of the label, where the graphic device is a drawing or photograph of the food item to be wrapped or contained. For instance, a label for a double cheeseburger would include a picture with the food item disassembled sufficiently so that a viewer could instantly appreciate the presence of two hamburger patties and two slices of cheese with the typical bun in the presence of the wrapper in the background. In a preferred embodiment, all the labels comprise such a disassembled food product picture or drawing in the clear presence of the wrapper or box in which it is contained.

9 Claims, 6 Drawing Sheets

CUSTOMER ORDER AND BILLABLES CONFIRMATION METHOD

FIELD OF THE INVENTION

The present invention relates to the preparation and assembly of orders for assembly line type restaurants typical of fast food services.

BACKGROUND OF THE INVENTION

It is well known that fast food restaurants are significantly different from previous restaurant systems in floorplan layout, in segregation of operations, and in flow of work. The now-famous McDonald brothers invented the Speedee system of fast-food production. Prior the this system, restaurants were capable of making individual food items quickly with the superior skills of a single chef. These short order cooks are still in high demand outside of the fast food industry. The fast food method of food production eliminated the need for a highly skilled person with multiple abilities. The fast food industry requires many minimally trained persons capable of performing a single function over and over again in a segregated and specific area to facilitate quick receipt of inputs to the area (orders, food materials for the local operation, partly formed menu items, fully assembled menu items requiring wrapping, etc.) and equally quick transmission of outputs from the area (partly formed menu items, fully assembled menu items requiring wrapping, wrapped food items, wrapped food items placed in bags, boxes or trays for delivery to a customer, etc.).

In short, the fast food system generally conducts business to induce a customer to approach a counter or drive through portion where an order is placed, have the food order transmitted to a preparation and assembly area where the food is prepared and assembled, have completed food items wrapped individually, have the wrapped food items placed on a tray, in a bag or in a box, and then have the contained food items delivered to a customer in exchange for payment. With very specific exceptions, the layout of the fast food restaurant does not allow for substantial accumulation of partially or fully assembled menu items. Preparation and customer order pick up areas are minimized in favor of providing more floor space to other uses. Many fast food restaurants use a location between the customer pick up areas and the preparation areas for highly ordered storage of wrapped menu items that can be taken, one or more at a time, by persons assembling an order for a customer. However, space for gathering the wrapped menu items into a bag or box or onto a tray is very limited and there is tremendous pressure to conduct the assembly of an order and high speed to improve throughput and overall efficiency of the operation.

With the pressure to assemble at high speed comes the certainty that mistakes are made in collection of menu items for fast food orders. The overall speed and inability to concentrate on a single order by order assembly personnel typically is a disincentive for a customer to return to have an order corrected with the ordered item. If a drive through order contains the wrong items, a customer cannot typically take time to park, return to the indoor order counter, and get the attention of staff to correct the order. The effect of this disincentivizing of correction of fast food orders means that a customer is lost more easily by experiencing significant mistakes in orders. Alternately, customers become accustomed to being more aggressive and sometimes angry with staff over mistakes in orders, causing additional pressure on the already pressured personnel.

The prior art contains some efforts to address the issue of reducing mistakes made in assembly of fast food orders. U.S. Pat. No. 4,864,243 describes a box for a single or multiple food items, where food items to be contained in the box are identified to a bearer of the box by tabs removed, where each tab is specific to a food item within the box. In this way, an order assembly person is able to instantly view the tab indicators of the food order. This system suffers from a disability in that the time and motion required for pressing or activating tab indicators requires a thorough present understanding of specific order and the ability, under pressure, to perform the required activation. A further problem with this system is that personnel, under pressure, will fulfill the order's tab activation before the food items are actually placed in the box. In that circumstance, reduction in order mistakes is unlikely to be reduced over not using the patented system. Additionally, the prior art containers of the '243 patent are made for use, when manufactured, with only a fixed number of specifically identified food items. Number of menu items, food item names, and the availability of reduced price purchase of a specific set of food items change often in a typical fast food restaurant. Limited time promotions offering specific food items or promotional toys may change weekly. A system providing for bags or boxes of a food order at a fast food restaurant must have the ability to adapt to these many changes related to food items without requiring disposal of outdated order packaging, as will occur with use of the boxes of the '243 patent. Disposing of such outdated packaging increases solid waste output of an entire chain of fast food restaurants and can have a substantial effect on waste disposal.

There is a need for a fast food order assembly system where there is little opportunity for avoiding or making mistakes in steps which reduce the risk of mistakes in orders, while providing the customer with an expectation that an easily visible means will allow them to check the accuracy of the contents of their tray, bag or box as to food or menu items therein.

In addition, the steps of modern surgical procedure include a somewhat related concept of confirmation. While conducted by some of the most highly trained persons of our society, complex surgical procedures may include the use of so many instruments that errors sometimes occur in their removal from the surgical site after they have been used. A typical solution is to provide nursing or support personnel whose major role is to account for all instruments at all times. However, similar to the situation in a fast food restaurant, some procedures are fast paced and pressure is high. Different from the fast food restaurant, many times all persons are focused on saving a life instead of accounting for instruments. In such a situation, it is possible to lose track of instruments as they are being used. There is also a need for a better way of keeping track of surgical instruments as they are being used.

Current surgical practice has become widely distributed due to improvements in procedures and reduced cost and size of equipment to perform those procedures. Very important surgeries can be performed at small, outpatient surgical centers or doctors' offices. Distribution of surgical care is occurring at the same time as stricter procedures for accounting for all chargeable use of equipment, implanted devices and disposable materials used in each surgical procedure. Both government administered programs and private health insurers are requiring clear evidence of each billable item for which they are liable for payment. However, in all medical provider venues, nursing and support personnel are a substantial expense and their involvement in making sure every billable item of a surgery has been properly entered in a written log may be reduced in favor of more critical aspects of patient care. As such, a typical surgical procedure may conclude with disposables used and removed for disposal before staff have determined every disposable used. Some effort can be made to review inventory before and after a procedure to have a general idea of disposables (such as gauze, scalpels, sutures, syringes, catheters, breathing tubes or masks, valves, gowns, gloves, caps, etc.) used in the procedure, but many times only a best estimate of disposables used in a surgical procedure can be made and submitted for payment. Best estimates are often not acceptable to actually obtain payment for these disposables used in a surgical procedure. There is a need for a system by which surgical procedure disposables used in a specific procedure may be accurately accounted for at all stages of the procedure.

SUMMARY OF THE INVENTION

The present invention is a system of order assurance for fast food restaurant operations. An object of the invention is to minimize changes to existing packaging for individual food items and for take out containers for those food items while providing restaurant personnel and an order-receiving customer immediate appreciation as to the contents of the take out containers. A further object of the invention is to minimize solid waste in application of the system, a major concern for the fast food industry. A further object of the invention is to reduce costs by virtually eliminating food losses to the restaurant, in that a customer will appreciate at a pick up area of the restaurant any mistake in their order, allowing restaurant staff to replace the incorrect food item in inventory for another customer. Where a customer leaves the pick up area and returns requires a restaurant to dispose of the mistaken food item due to safety concerns.

The present invention comprises a system of labels located on wrapping and containers for individual food items. Each label contains an alphanumeric and/or graphic design that instantly brings to mind of restaurant personnel and to an unsophisticated customer (i.e., someone with no knowledge of the English language, children, or adults with limited education) the food item to be wrapped with the wrapping or container. In a preferred embodiment, a graphic device occupies a majority of the surface of the label, where the graphic device is a drawing or photograph of the food item to be wrapped or contained. For instance, a label for a double cheeseburger would include a picture with the food item disassembled sufficiently so that a viewer could instantly appreciate the presence of two hamburger patties and two slices of cheese with the typical bun in the presence of the wrapper in the background. In a preferred embodiment, all the labels comprise such a disassembled food product picture or drawing in the clear presence of the wrapper or box in which it is contained.

In another embodiment of the invention, a pull off portion of the label is formed of opaque material such as colored or white paper and a remaining portion of the label is formed of clear material. Alternately, the pull off portion of the label may be clear excepting an imprinted portion for the text or graphic device indicating the food item. In this embodiment, the wrapper or food item will bear the logo, trademark or other most prominent advertising indicia of the restaurant in significant size. Most wrappers and containers for individual food items at fast food are specially printed so that this advertising indicia is easily visible to a customer after their food item is wrapped, typically so that the indicia faces upward when the wrapped food item is placed on a horizontal or slightly inclined surface (such as a counter or downward angled trough for that particular food item). In this embodiment, it is preferred that the remaining portion of the label be adhesively placed over this indicia area on the wrapping or container so that the pull off portion of the label partly obscures the advertising indicia. In this way, a pull off portion that is not removed by an order assembly personnel will obviously improperly remain part of the wrapper or container when the wrapped food item is deposited into a take out bag or box for a specific customer order.

The invention system requires that order assembly personnel, at the order assembly stage for a specific order, remove the pull off portion of the label and adhesively attach the label to a label bearing portion of the customer's take out bag or box. Both the order assembly personnel and the customer can instantly appreciate the contents of the order bag or box. There may be segregated label bearing portions of the bag or box where types of food (separated by divisions such as "sandwiches" and "side orders") so that a customer can more quickly focus on food items, such as more expensive main course items, can be reviewed as being within the bag or box.

It is preferred that the label bearing portions be located so that presentation of the order bag or box to a customer generally require the customer to view the attached labels. If a mistake is made in the order, a customer can quickly, and with minimal disturbance to the customer relationship, get the order fulfilled correctly. If the customer leaves and returns after discovering an error in the contents of the take out bag or box, the customer is less likely to be aggressive or angry where it would have been so easy for them to have quickly checked the contents of the take out bag or box.

The only significant cost of the invention system for a fast food operation is the addition of the labels to wrappers or containers for individual food items. A change in imprinting the take out bags and boxes is minimized, in that there is already typically open space on such bags and boxes that is available for attachment of the pull off portion of the labels. In another embodiment of the invention, order assembly personnel are able to lift a wrapped or packaged food item from a resting position at an intermediate product accumulation or storage area, deposit the food item in the invention take out bag or box, remove the pull off part of the label and attach that label to the take out bag or box in the appropriate place with little loss of time or motion over the prior art motions required for order assembly.

The invention system also includes use of an attachment portion and pull off portion of a label on packaging for surgical instruments.

DETAILED DESCRIPTION OF THE INVENTION

The invention is now discussed with reference to the figures.

Figure 1:
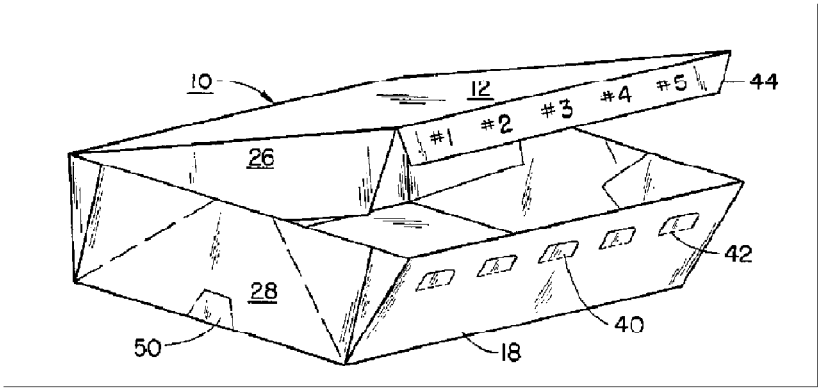
FIG. 1 PRIOR ART
FIG. 1 is a prior art tab indicia box for order fulfillment in a fast food operation.

FIG. 1 is a prior art tab indicia box for order fulfillment in a fast food operation as shown and described in U.S. Pat. No. 4,864,243.

Figure 2:
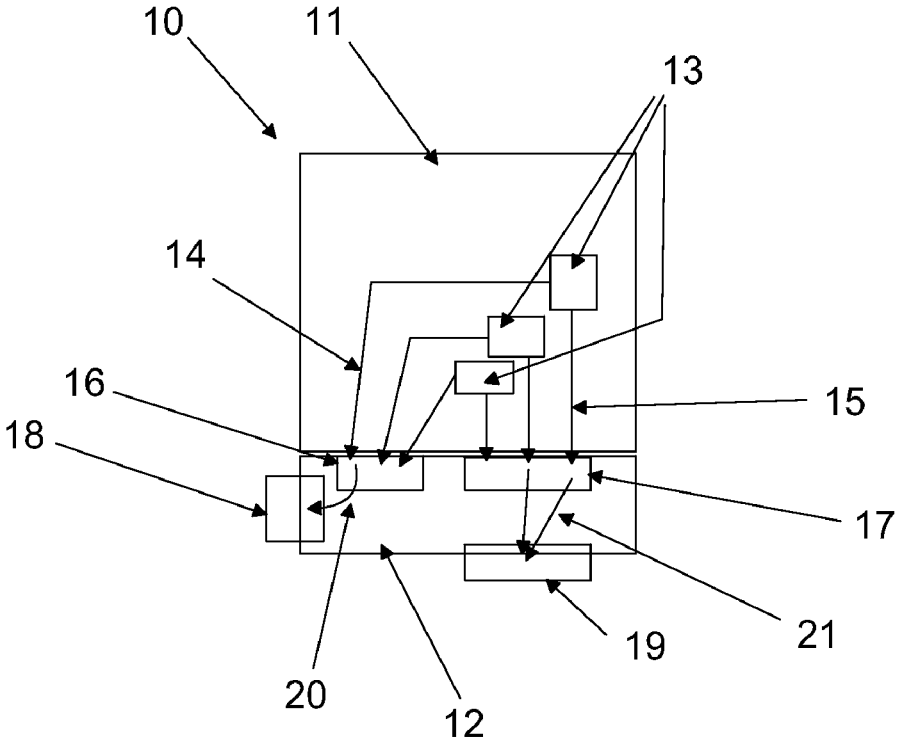
FIG. 2 is a generalized top view of food preparation and order fulfillment areas of a fast food restaurant.

FIG. 2 is a generalized top view of food preparation area 11 and order fulfillment area 12 of a fast food restaurant 10. Preparation areas comprises multiple food preparation stations 13, only some of which produce a fully assembled and wrapped food product to drive through product waiting area 15 by paths 14 or to counter product waiting area 17 by paths 15. Product waiting areas 16 and 17 are shown with relatively large surfaces but in fact comprise limited working space, with the rest reserved for wrapped food items awaiting potential or placed orders. Order assembly personnel gather wrapped food items from waiting areas 16 and 17 and respectively deliver bagged or boxed orders to drive through pick up area 18 by path 20 or to counter pick up area 19 by path 21. Order fulfillment area 12 is an area of operations for order taking and delivery staff to the drive through window and take out counter. areas 16 and 17 are shown with relatively large surfaces but in fact comprise limited working space, with the rest reserved for wrapped food items awaiting potential or placed orders. Order assembly personnel gather wrapped food items from waiting areas 16 and 17 and respectively deliver bagged or boxed orders to drive through pick up area 17 by path 20 or to counter pick up area 19 by path 21. Order fulfillment area 12 is an area of operations for order taking and delivery staff to the drive through window and take out counter.

Figure 3:
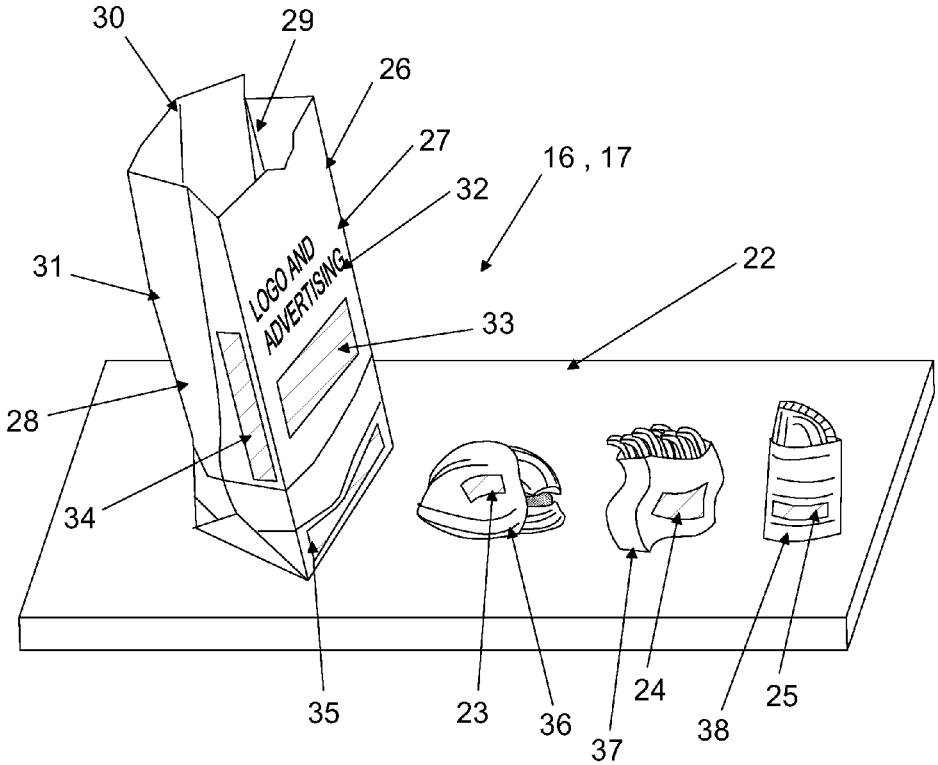
FIG. 3 is a perspective view of a take out bag and three wrapped or contained menu items prior to being placed in the bag.

FIG. 3 is a perspective view of a take out bag 26 and three wrapped or contained menu items 36, 37, and 38 supported on an order assembly counter 22. This scene is typical of a fast food order prior to packing in a bag 26 or a take out box. It is clear that a fast paced assembly of the order would be to merely scoop each item 36, 37 and 38 into the top opening 30, roll the top edge 29 down to about level 31 to close bag 26 and hand the packed order bag to a customer. Orders are typically displayed on a computer screen substantially above the level of counter 22, requiring an undue degree of switching an assembly personnel's view from up to down, inducing a certain degree of error from fatigue. Alternately, orders may be printed on rather faint or small type size on a slip of paper to be delivered to the customer as their receipt. Once again, fatigue from careful checking of small and/or faint print induces a certain level of mistakes in order fulfillment. The invention system provides not only personnel, but perhaps more importantly, the customer, in the process of order fulfillment. As such, bag 26 comprises outside surface area on front and back sides 27 (where LOGO AND ADVERTISING 32 are placed as an essential part of the continuing business) and left and right sides 28, whereupon labels from label areas 23, 24, and 25 (for, respectively, items 36, 37, and 38) are to be removed and placed on bag 26 in easily viewable label areas. Label area 34 may be, as an example, located on side 28 so that a fold on side 28 does not interfere with placement or retention of adhesively applied labels. Label area 34 is especially advantageous for placement of labels from items 36-38 because the labels do not interfere visually with a presentation of the LOGO AND ADVERTISING 32 on a major surface of bag 26.

Alternately, labels may be placed upon label surfaces 33 or 35 depending upon a restaurant owner's preference for locating the labels closer to or farthest from LOGO AND ADVERTISING 32. A reason to locate the labels close to the LOGO AND ADVERTISING 32 might be a present program of giving of promotional items or toys with certain meals or food items, where a packaging of such promotional items would also bear a removable label which would be removed and placed in a label area of bag 26 to indicate one of a selection of promotional items were contained in bag 26. The anticipation that an indication of the promotional item would be present in the form of a label adjacent to food item labels would induce a customer to immediately view those food item labels and coincidentally confirm their order.

Figure 4:
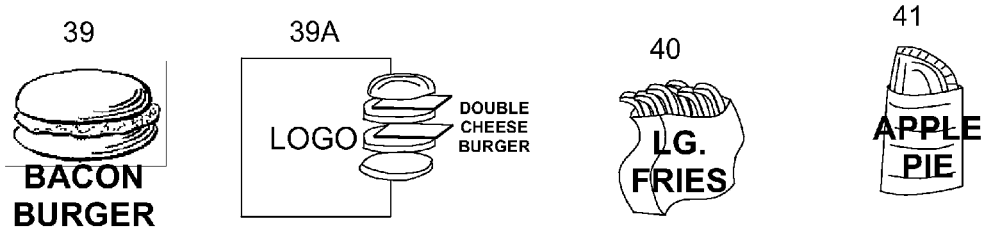
FIG. 4 are four representative text and icon images which may be used on a pull off portion of the invention labels.

FIG. 4 shows exemplary label text and icons 39 (for a bacon burger), 39A (for a double cheeseburger with essential elements separated with a wrapping sheet in its background), 40 (for a large French fries), and 41 (for an apple pie). These are exemplary of text and icons which immediately bring to mind an ordered fast food item. Text and icons 39, 39A, 40, and 41 may be imprinted on a pull off portion of the labels which are attached to food item packaging which must be used in every instance for wrapping or containing individual food items.

Figure 5:
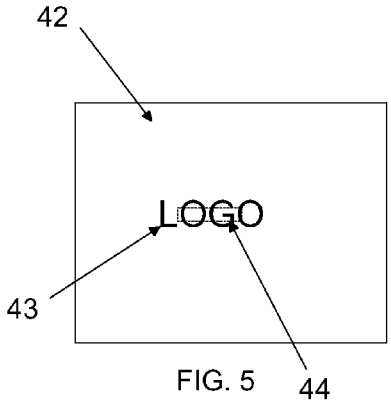
FIGS. 5, 6 and 7 are, respectively, top views of a single sheet of food item wrapping paper, an open top paper bag (typically used for French fries), and an expandable box for items such as apple pies according to the invention, showing an advertising indicia location and a label placement location.
Figure 6:
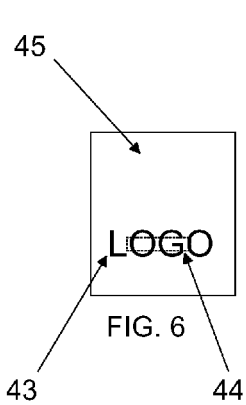
Figure 7:
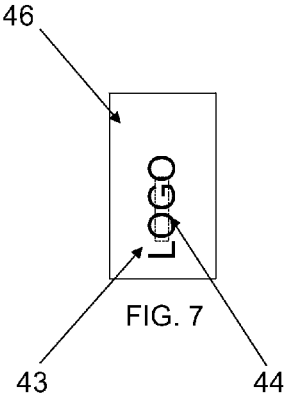

FIGS. 5, 6 and 7 are, respectively, top views of a single sheet of food item wrapping paper 42, an open top paper bag 45 (typically used for French fries), and an expandable box 46 (for items such as apple pies). Each wrapper or container bears a LOGO portion 43 in a section of the wrapper or container so that, after a food item is wrapped or contained, the LOGO is presented to the view of a customer when the wrapped or contained food item is placed upon a flat surface. Wrapping and packaging in the fast food industry has specifically evolved to incorporate this packaging feature so that promotion and advertising continues even after a purchase has been completed. In addition, label placement zone 44 is shown in broken lines as a preferred location for adhesive attachment of the invention labels. In locating the labels directly upon the LOGO of the company, personnel will find it more difficult to ignore the clearly present label on a wrapped or contained food item and make it more likely that the labels will be removed and applied to the bag or box in the order fulfillment process. Referring again to FIG. 3, it is seen quite clearly that a removable pull off portion of a label may be present on the wrapper or container in label areas 23-25.

Figure 8:
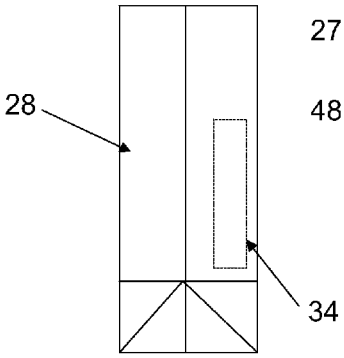
FIGS. 8 and 9 are, respectively, side and front views of the bag of FIG. 3 showing potential label bearing portions.
Figure 9:
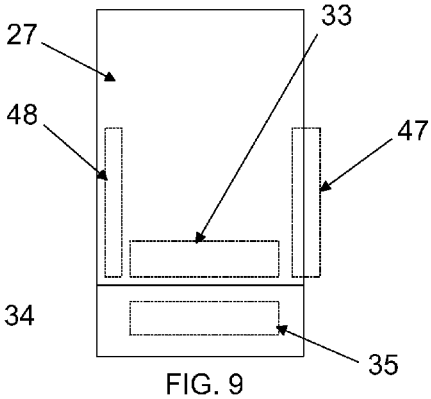

FIGS. 8 and 9 are, respectively, side and front views of the bag 26 of FIG. 3 showing potential label bearing portions 33, 34, 47 and 48. Portion 48 is defined at a bag edge so that pull off portions of the invention labels comprise adhesive on an underside of about half of the label, where the adhesive portion attaches the pull off portion to the area near the bag edge so that another half extends outward from the bag edge to make it more distinctive from the rest of the bag printing.

Figure 10:
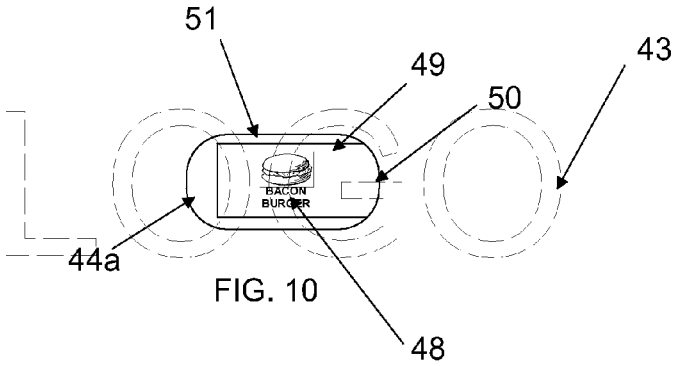
FIG. 10 is at top view of an exemplary label of the invention showing an advertising indicia in broken lines.
Figure 11:
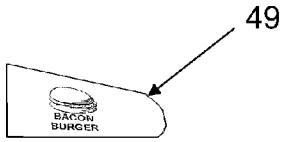
FIG. 11 is a pull off portion of the label of FIG. 10 flexed for lifting by order assembly personnel.

FIG. 10 is at top view of an exemplary label 44*a* of the invention showing an advertising indicia 43 in broken lines. Label 44*a* comprises an attachment portion 51 comprising a flat, flexible, sheet material coextensive with the outline of label 44*a* with adhesive on an underside so that attachment portion 51 can be attached to the flexible sheet material or containers used for wrapping or containing food items. A top part of attachment portion 51 comprises a removable surface coextensive with pull off portion 49, which comprises an adhesive underside that causes it to remain attached to said removable surface until restaurant personnel lift front tab 50 for removing pull off portion 49 from the attachment portion. Pull off portion 49 comprises text/icon food item indicator 48 printed on a top surface. Restaurant personnel are to remove pull off portion 49, which flexes as shown in FIG. 11, for placement on the order fulfillment bag or box, as shown in FIG. 12.

Figure 12:
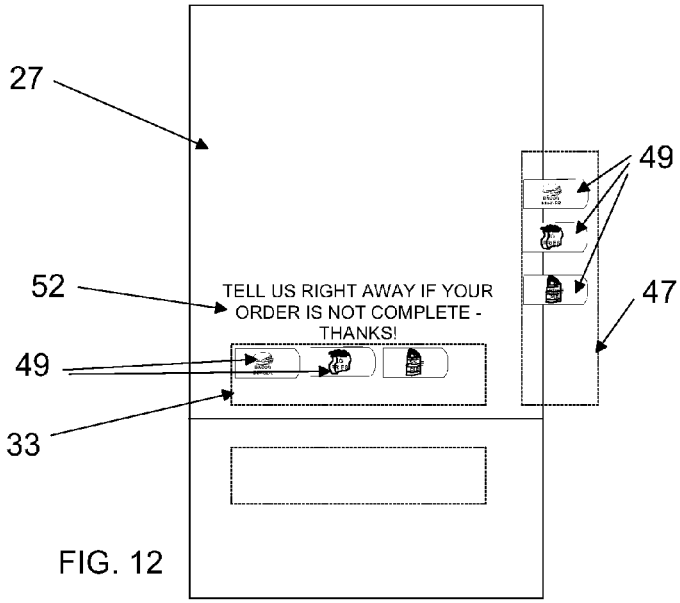
FIG. 12 is the bag of FIG. 9 showing labels attached for the three food items shown in FIG. 3.

FIG. 12 shows the view of the bag in FIG. 10 where pull off portions 49 have been applied for the three food items shown in FIG. 3, showing that only those food items are contained in the bag. Label bearing portion 47 shows a form of the invention pull off portion extending beyond the bag edge. This form of the invention pull off portion is more easily removed from the attachment portion of the label than a pull off portion with a fully adhesive backside. Notification 52 is a critical part of one embodiment of the invention, in that the customer is requested in bold text to inspect the attached pull off portions with their imprinted identification means to confirm immediately that the their order has been filled correctly.

Figure 13:
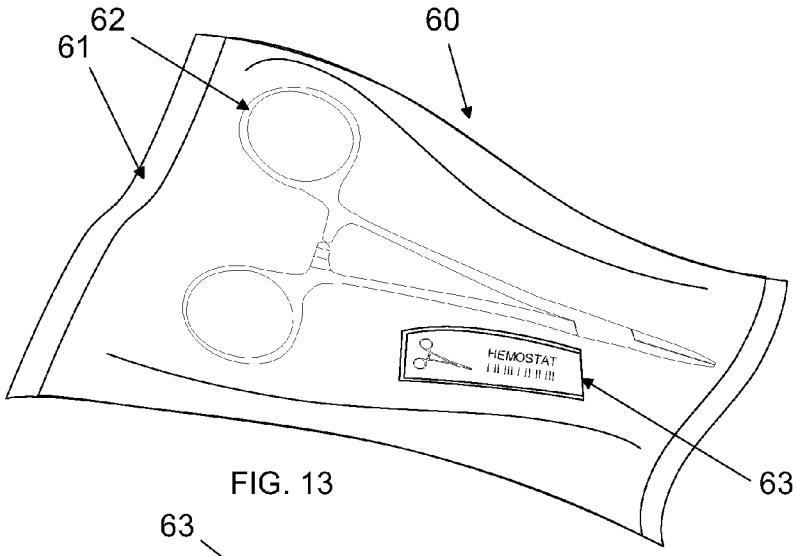
FIG. 13 is a top view of a surgical device in a clear bag bearing the invention label.
Figure 14:
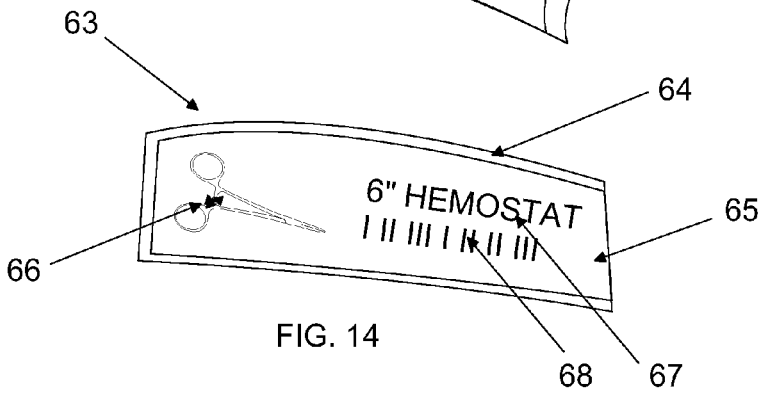
FIG. 14 is a top view of an invention label for use in surgical procedures.

FIG. 13 is a top view of an assembly 60 comprising a surgical device 62 in a clear bag 61 bearing the invention label 63. FIG. 14 is a top view of an invention label 63 comprising an attachment portion 64 for attaching the label 63 to a bag, box or other container for a surgical device. Label 63 might be attached directly to a surgical device. Pull off portion 65 is removable from attachment portion 64 and is adhesively attachable to a paper, board, tray, table, absorbent pad or other convenient surface for review by personnel to quickly determine instruments being used. Pull off portion 65 comprises graphic device 66 (which may indicate the instrument used), text 66 (which may state the specific instrument used), or bar code 67 (which may be used to identify the specific instrument contained in a container and removed therefrom for use in surgical procedures. The invention system intends that pull off portion 65 will be removed just prior to use of a device from its container and that all pull off portions (or all from similar instruments) will be attached to a convenient surface for review at any time by personnel.

Figure 15:
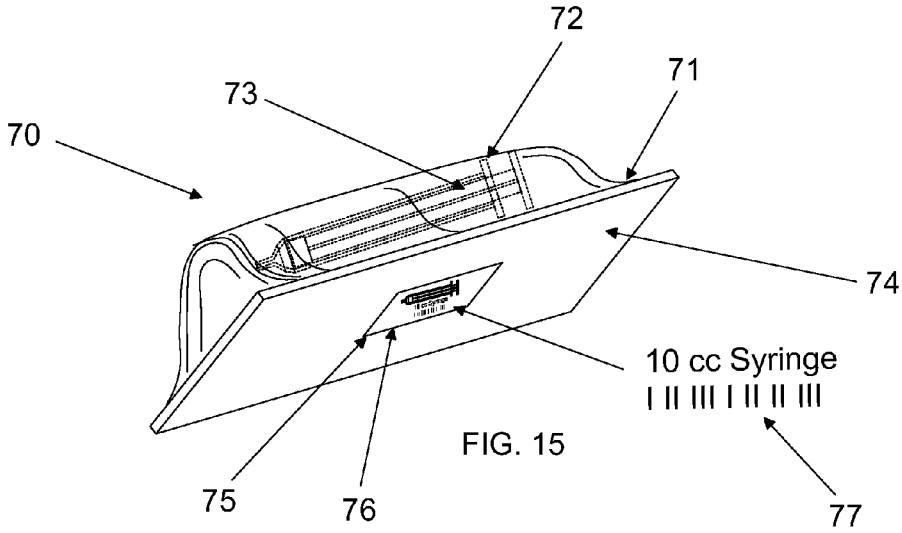
FIG. 15 is a bottom perspective view of a medical disposable bearing an invention label.

FIG. 15 is a bottom perspective view of a medical disposable 70 bearing an invention label 75. Disposable 70 represents a typical package of a sterile disposable device, such as a syringe, catheter, mask, etc. formed with a printed base card or sheet 74 with a bottom side comprising printing and product information and a top side. Extending upward or from edges of the top side of sheet 74 is typically a clear packaging cover 72 enclosing in a sterile environment a disposable device 73. Device 73 is shown in broken lines to be a disposable syringe. In a surgical procedure, a non-sterile exterior surface of disposable 70 is handled by a staff person whose hands are not sterile but pulls back sheet 74 from cover 72, exposing a sterile device 73 for withdrawal by a staff person with sterile gloves for use in a sterile surgical field.

The invention label 75 comprises a pull off portion as described above. An outside surface of label 75 bears a textual or graphic indication of the device 73 and, optionally, a bar code which is readable by a bar code reader. Text and bar code section 77 is shown in an enlarged view.

In practice, as staff withdraw from the edge of the sterile field bearing empty packaging of disposable 70, that staff will remove the pull off portion of label 75 and adhesively attach it to a surface where a later cumulative accounting of medical disposables can be made. In a first embodiment after the surgical procedure, a staff person can transfer the information of the disposables 70 used in the procedure by examining the pull off portions of labels 70 which have been attached to a board, table surface, wall, clipboard or other such device.

Figure 16:
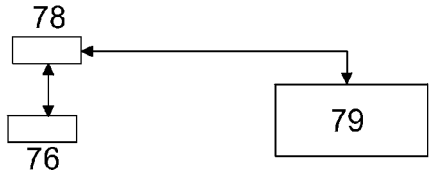
FIG. 16 is a block diagram representing a process for inputting to a computer or computer network information relating to use of the medical disposable of FIG. 15.

In a second embodiment, each bar code of each label 75 is capable be read by a bar code scanner or reader and is associated with a unique alphanumeric code representing only the individual item 73 of a single disposables 70. The process of used disposables accounting is shown in FIG. 16, where a pull off portion of label 75 is shown scanned by bar code scanner 78, whereupon signals representing that bar code are transmitted to a computer or computer network 79 and stored there. A control program of the network 79 acts to identify as disposable items used in the surgery with the received unique alphanumeric codes to prepare an output which indicates the specifications of and number of disposable items used during a surgical procedure.

It would be preferable to prevent early removal of the pull off portion of label 75 so that staff was not inclined to do so in anticipation of the use of some disposables. If those disposables were not actually used but their labels' presence on a billing board caused billing to occur for them, billing would occur for disposable items not used. In another embodiment of the invention, label 75 is located on an inside surface within the sealed, sterile space of disposable 70 of FIG. 15. Staff cannot remove a pull off portion of label 75 unless the sterile seal has been broken, in which case the disposable item inside could not be used in or charged to any other surgical procedure.

In an alternate embodiment, disposable medical sharps are identified as a special sub-class of all medical disposables 70 by way of bar code or other alphanumeric indication. As the pull off portion of labels 75 are removed during the surgical procedure, all labels removed from medical sharps packaging are segregated to a surface reserved for and indicated by title as being only for pull off portions of labels from medical sharps. Disposable medical sharps include scalpels, suture needles, and hypodermic needles and must be accounted for after every surgical procedure. In a further alternate embodiment, a medical sharps container box is capable being opened and latched closed and comprises inside surface area where pull off portions of labels 75 can be adhesively placed. These pull off portions are arranged so that sharp ends of the medical sharps can pierce a supported length of the pull off portion after its medical sharp has been used in the surgical procedure. At a final counting for medical sharps a pull off portion that is not visibly pierced by its medical sharp is clearly unaccounted for and gives an instantaneous indication that not all medical sharps have been found.

The invention accounting system for assuring that expendables or consumables used in the course of a surgical procedure are entered for billing purposes include medications and the like. Medications and intravenous solutions often bear non-removable bar coding indicating a general class or type of expendable. Sometimes a non-removable bar coding label will be applied to an exterior of the medication or intravenous solution, where loss or removal of such a prior art label could create a dangerous situation. In short, for such medications and intravenous fluids, the presence of removable labels is disfavored. In the invention system, medications and intravenous fluid containers bear an additional label, a removable one according to the invention, whose text, graphic and/or bar coding (or other coding) maps to an accounting entry in the computer system when the label has been removed and placed upon a consumables reading surface just prior to the consumable being used.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A system for visual order confirmation of wrapped food items prepared in a preparation area of a fast food restaurant, individually wrapped in a disposable flexible sheet wrapper or contained in a disposable container, and presented to order fulfillment staff as wrapped food items for order fulfillment by way of placing a selection of wrapped food items in a take out bag, the improvement comprising:

(a) a label comprising an attachment portion and a pull off portion, where the attachment portion is attached at an underside to a label attachment zone of the sheet wrappers or containers and the attachment portion has a topside bearing a removable pull off portion formed of flexible sheet material;

(b) the pull off portion bears identification means in the form of a graphic device or set of text which immediately identifies to a viewer the specific food item in the wrapper or container after said specific food item is wrapped;

(c) the take out bag comprises one or more label surfaces on an outside surface where pull off portions are adhesively attached after being removed from a wrapper or container just prior to being placed in the take out bag and a viewer can easily appreciate from the identification means the contents of the take out bag;

(d) the take out bag comprises a major front and back sides and creased right and left sides and label surfaces are located on an uncreased portion of the right or left sides or on a lower portion of the front and back sides; and (e) pull off portions comprise an adhesive-free part of its underside, where an adhesive part is attached to a label surface at an edge of the bag so that the adhesive free part extends out from the edge of the bag.

2. The system of claim 1 wherein a central part of the front or back sides of the take out bag comprises text or graphic trademark identification of an entity owning the restaurant and the label surfaces do not overlap into that central part.

3. The system of claim 2 wherein additional label surfaces are adjacent to the central part.

4. The system of claim 2 wherein the additional label surfaces are distal to the central part.

5. The system of claim 1 wherein the identification means comprise a graphic representation of the food item to be wrapped.

6. The system of claim 5 wherein the graphic representation is an expanded or exploded view of major elements of said food item to be wrapped.

7. The system of claim 1 wherein a presentation part of the wrapper or container comprises text or graphic trademark identification of an entity owning the restaurant and the label attachment zones overlap at least in part the presentation part.

8. The system of claim 7 wherein the attachment portion is formed of clear material so that when the pull off portion is removed a viewer will view presentation part aspects through the clear attachment portion.

9. The system of claim 8 wherein the pull off portion is formed of clear material.

* * * * *